US012553237B2

(12) United States Patent
Lee et al.

(10) Patent No.: US 12,553,237 B2
(45) Date of Patent: Feb. 17, 2026

(54) CEILING PANEL APPARATUS AND METHOD OF MANUFACTURING THE SAME

(71) Applicant: E.M Tech Co., Ltd., Gangneung-si (KR)

(72) Inventors: Chang Gi Lee, Gangneung-si (KR); Young Nam Ahn, Incheon (KR); Chi Joung Kim, Osan-si (KR)

(73) Assignee: E.M Tech Co., Ltd., Gangneung-si (KR)

( * ) Notice: Subject to any disclaimer, the term of this patent is extended or adjusted under 35 U.S.C. 154(b) by 175 days.

(21) Appl. No.: 18/417,611

(22) Filed: Jan. 19, 2024

(65) Prior Publication Data

US 2025/0059762 A1 Feb. 20, 2025

(30) Foreign Application Priority Data

Aug. 18, 2023 (KR) ..... 10-2023-0108042

(51) Int. Cl.
*E04B 9/04* (2006.01)

(52) U.S. Cl.
CPC ..... *E04B 9/04* (2013.01); *E04B 2103/04* (2013.01)

(58) Field of Classification Search
CPC ..... E04B 9/04; E04B 2103/04; E04B 9/045; E04B 9/001; E04B 9/0478; E04B 1/94; B27N 3/02; B27N 3/08; E04F 13/0875
See application file for complete search history.

(56) References Cited

U.S. PATENT DOCUMENTS

2006/0191226 A1* 8/2006 Kim ..... E04F 15/02405 52/781.3
2023/0417054 A1* 12/2023 Nilsson ..... E04B 1/86

FOREIGN PATENT DOCUMENTS

| | | | | |
|---|---|---|---|---|
| DE | 102004056333 | A1 * | 6/2006 | ..... G10K 11/168 |
| EP | 2830042 | A1 * | 1/2015 | ..... B29C 70/224 |
| KR | 10-2005-0005382 | A | 1/2005 | |
| KR | 20050005382 | A * | 1/2005 | |
| KR | 10-2010-0132130 | A | 12/2010 | |
| KR | 20200077977 | A * | 7/2020 | ..... E04B 9/045 |
| KR | 102192516 | B1 * | 12/2020 | ..... E04B 9/045 |
| KR | 10-2023-0111899 | A | 7/2023 | |

* cited by examiner

*Primary Examiner* — Adriana Figueroa
(74) *Attorney, Agent, or Firm* — Bridgeway IP Law Group, PLLC; Sang Ho Lee; Hyun Woo Shin

(57) ABSTRACT

Provided is an eco-friendly ceiling panel apparatus mountable on the ceiling of a building, and a method of manufacturing the same, the ceiling panel apparatus including a base substantially having a rectangular plate shape and made of a first material, and one or more reinforcing members substantially having a rod shape, made of a second material, and provided in the base to prevent sagging of the base, wherein the reinforcing members are disposed in a diagonal direction of the base.

17 Claims, 8 Drawing Sheets

SECTION B-B

CEILING PANEL APPARATUS AND METHOD OF MANUFACTURING THE SAME

CROSS-REFERENCE TO RELATED PATENT APPLICATION

This application claims the priority and benefit of Korean Patent Application No. 10-2023-0108042, filed on Aug. 18, 2023, in the Korean Intellectual Property Office, the disclosure of which is incorporated herein in its entirety by reference.

STATEMENT REGARDING SPONSORED RESEARCH OR DEVELOPMENT

The present invention was undertaken with the support of the development of fiberboard for multi-color hybrid composite material using pumice resources with low-temperature ceramic coating, No. 1425179352 grant funded by Ministry of SMEs and Startups of the Republic of Korea.

BACKGROUND OF THE INVENTION

1. Field of the Invention

The present invention relates to a ceiling panel apparatus and a method of manufacturing the same and, more particularly, to an eco-friendly ceiling panel apparatus mountable on the ceiling of a building, and a method of manufacturing the same.

2. Description of the Related Art

For ceiling panel apparatuses which are commonly used as a type of interior material in buildings, a single material such as plaster or asbestos may be formed at a certain size and used, or a dual-material panel obtained by forming a non-combustible sheet layer on a base layer generally made of glass wool is used.

However, according to these existing ceiling panel apparatuses, a high material cost leads to an increase in cost and asbestos, which contains large amounts of harmful substances that cause various diseases, is very strictly restricted these days.

In addition, because the above-described panel including glass wool and the non-combustible sheet has a low strength, the surface is easily damaged and the appearance seriously deteriorates within a few years after installation. Furthermore, due to a low fire resistance which is the most critical issue, when a fire breaks out, a fatally dangerous situation may occur.

As such, a non-combustible paint is coated on the surface nowadays. However, problems such as vulnerability to fire, poor appearance, and harmfulness to health still exist. Besides, due to environmental issues such as global warming, the interest in environmental degradation in various fields and solutions thereto is increasing worldwide. Therefore, the number of users who want materials that are not harmful to the human body is increasing and eco-friendly ceiling panel apparatuses are urgently needed particularly for places such as schools.

SUMMARY OF THE INVENTION

The present invention provides a ceiling panel apparatus capable of reducing product weight and producing eco-friendly products that do not harm the health of users or the environment, by forming a base with a cork material and forming reinforcing members with an eco-friendly material such as bamboo, paulownia, oak, cypress, or wood, and of firmly supporting the base without sagging, by diagonally disposing the reinforcing members in the base, and a method of manufacturing the same. However, the above description is an example, and the scope of the present invention is not limited thereto.

According to an aspect of the present invention, there is provided a ceiling panel apparatus including a base substantially having a rectangular plate shape and made of a first material, and one or more reinforcing members substantially having a rod shape, made of a second material, and provided in the base to prevent sagging of the base, wherein the reinforcing members are disposed in a diagonal direction of the base.

The first material may be an eco-friendly material including a cork material made by selecting at least one of oak, cypress, cork oak, and combinations thereof, and the second material may be a material including rods made by selecting and cutting at least one of bamboo, paulownia, oak, cypress, wood, pulp, paper, natural resin, synthetic resin, and combinations thereof, or one of low-rust metal, stainless steel, aluminum, copper, and combinations thereof.

The second material may be bamboo, the reinforcing members may have a circular rod shape, and the bamboo may have a grain pattern extending along a longitudinal direction of the reinforcing members on outer circumferential surfaces of the reinforcing members.

The reinforcing members may be spaced apart from each other by certain distances.

The base may be a square-shaped plate or panel with horizontal and vertical sides of equal length.

The reinforcing members may extend at both ends to an overlap region where an edge of the base overlaps a ceiling support.

The reinforcing members may include a first reinforcing member mounted in the base to extend a first length, and second reinforcing members mounted in the base to extend a second length less than the first length and disposed at positions spaced apart from the first reinforcing member by a first distance.

The reinforcing members may further include third reinforcing members mounted in the base to extend a third length less than the second length and disposed at positions spaced apart from the second reinforcing members by a second distance.

The first length may be a sum of the second and third lengths.

The base may have a square shape with horizontal and vertical sides of equal length, and the first length of the first reinforcing member may be greater than a product of the square root of 2 and a first underside length of an overlap region which meets the first reinforcing member.

The second length of the second reinforcing members may be greater than a product of the square root of 2 and a second underside length of the overlap region which meets the second reinforcing members.

The third length of the third reinforcing members may be greater than a product of the square root of 2 and a third underside length of the overlap region which meets the third reinforcing members.

The base may include a first layer provided on lower surfaces of the reinforcing members, or a second layer provided on upper surfaces of the reinforcing members and integrated with the first layer.

According to another aspect of the present invention, there is provided a method of manufacturing a ceiling panel apparatus, the method including a first layer forming step (a) for forming a first layer substantially having a rectangular plate shape and made of a first material, and a reinforcing member forming step (b) for forming one or more reinforcing members substantially having a rod shape, made of a second material, and provided in a diagonal direction on an upper surface of the first layer to prevent sagging.

The method may further include, after the reinforcing member forming step (b), a second layer forming step (c) for forming a second layer substantially having a rectangular plate shape, made of the first material, and provided on upper surfaces of the first layer and the one or more reinforcing members.

In the reinforcing member forming step (b), the second material may be bamboo, the reinforcing members may have a circular rod shape, and the bamboo may have a grain pattern extending along a longitudinal direction of the reinforcing members on outer circumferential surfaces of the reinforcing members.

In the reinforcing member forming step (b), the reinforcing members may extend at both ends to an overlap region where an edge of the base overlaps a ceiling support.

The reinforcing member forming step (b) may include a preparation step (b-1) for preparing three reinforcing members having a first length, a cutting step (b-2) for using one of the reinforcing members as a first reinforcing member and cutting the other two to prepare two second reinforcing members having a second length and two third reinforcing members having a third length, and a disposition step (b-3) for disposing the second and third reinforcing members at both sides of the first reinforcing member.

In the reinforcing member forming step (b), the reinforcing members may be fixed and flattened with at least one of a press, a high load, and a high temperature to prevent warping.

According to another aspect of the present invention, there is provided a ceiling panel apparatus including a base substantially having a rectangular plate shape and made of a first material, and one or more reinforcing members substantially having a rod shape, made of a second material, and provided in the base to prevent sagging of the base, wherein the base is a square-shaped plate or panel with horizontal and vertical sides of equal length, wherein the reinforcing members are disposed in a diagonal direction of the base, extend at both ends to an overlap region where an edge of the base overlaps a ceiling support, and include a first reinforcing member mounted in the base to extend a first length, second reinforcing members mounted in the base to extend a second length less than the first length and disposed at positions spaced apart from the first reinforcing member by a first distance, and third reinforcing members mounted in the base to extend a third length less than the second length and disposed at positions spaced apart from the second reinforcing members by a second distance, wherein the first material is an eco-friendly material including a cork material made by selecting at least one of oak, cypress, cork oak, and combinations thereof, wherein the second material is bamboo, wherein the reinforcing members have a circular rod shape, and wherein the bamboo has a grain pattern extending along a longitudinal direction of the reinforcing members on outer circumferential surfaces of the reinforcing members.

BRIEF DESCRIPTION OF THE DRAWINGS

The above and other features and advantages of the present invention will become more apparent by describing in detail embodiments thereof with reference to the attached drawings in which.

DETAILED DESCRIPTION OF THE INVENTION

Figure 1:
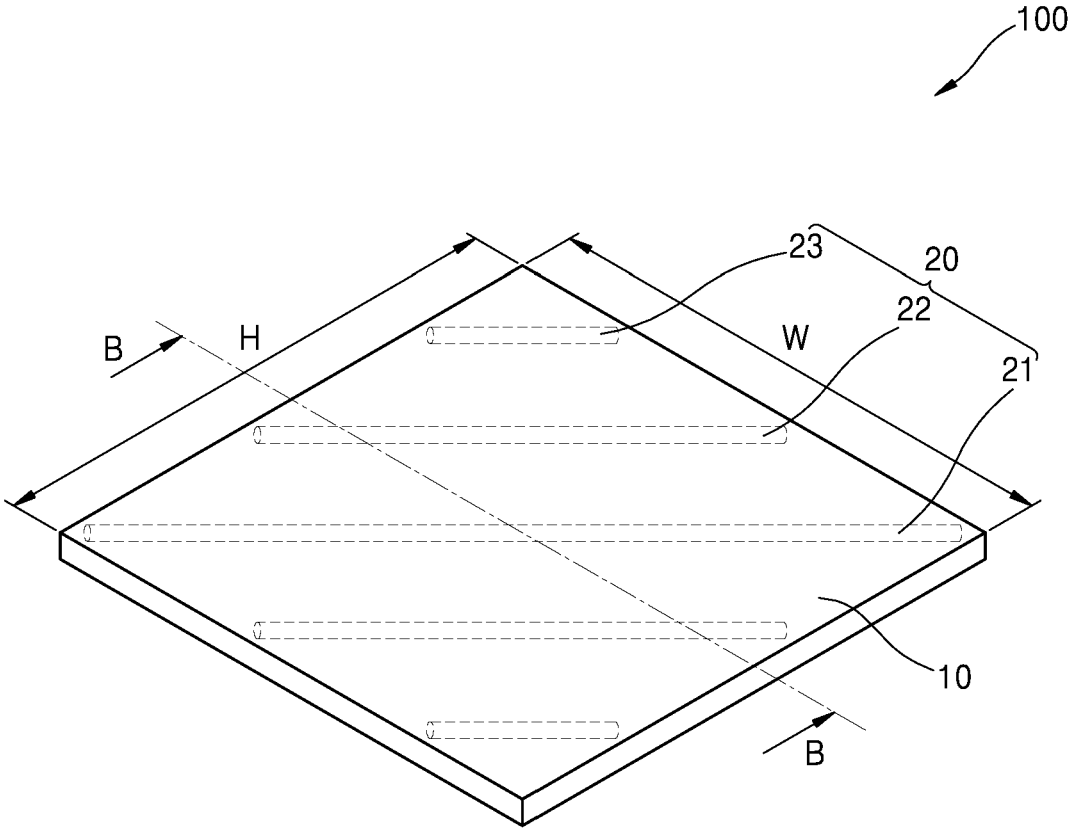
FIG. 1 is a perspective view of a ceiling panel apparatus according to an embodiment of the present invention.
Figure 2:
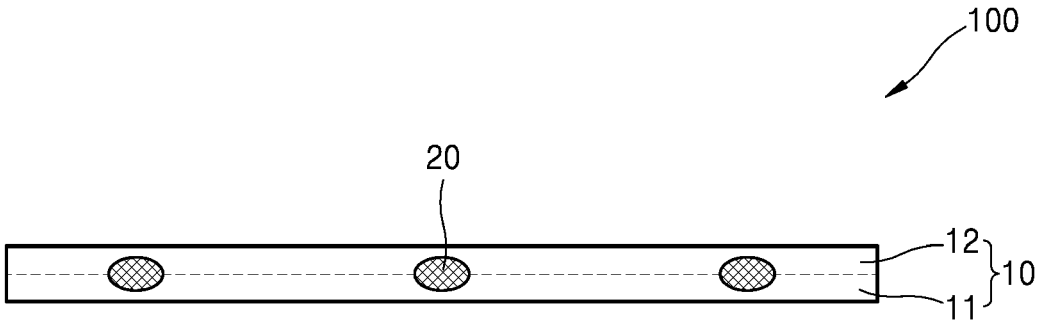
FIG. 2 is a cross-sectional view of the ceiling panel apparatus taken along line B-B of FIG. 1.
Figure 3:
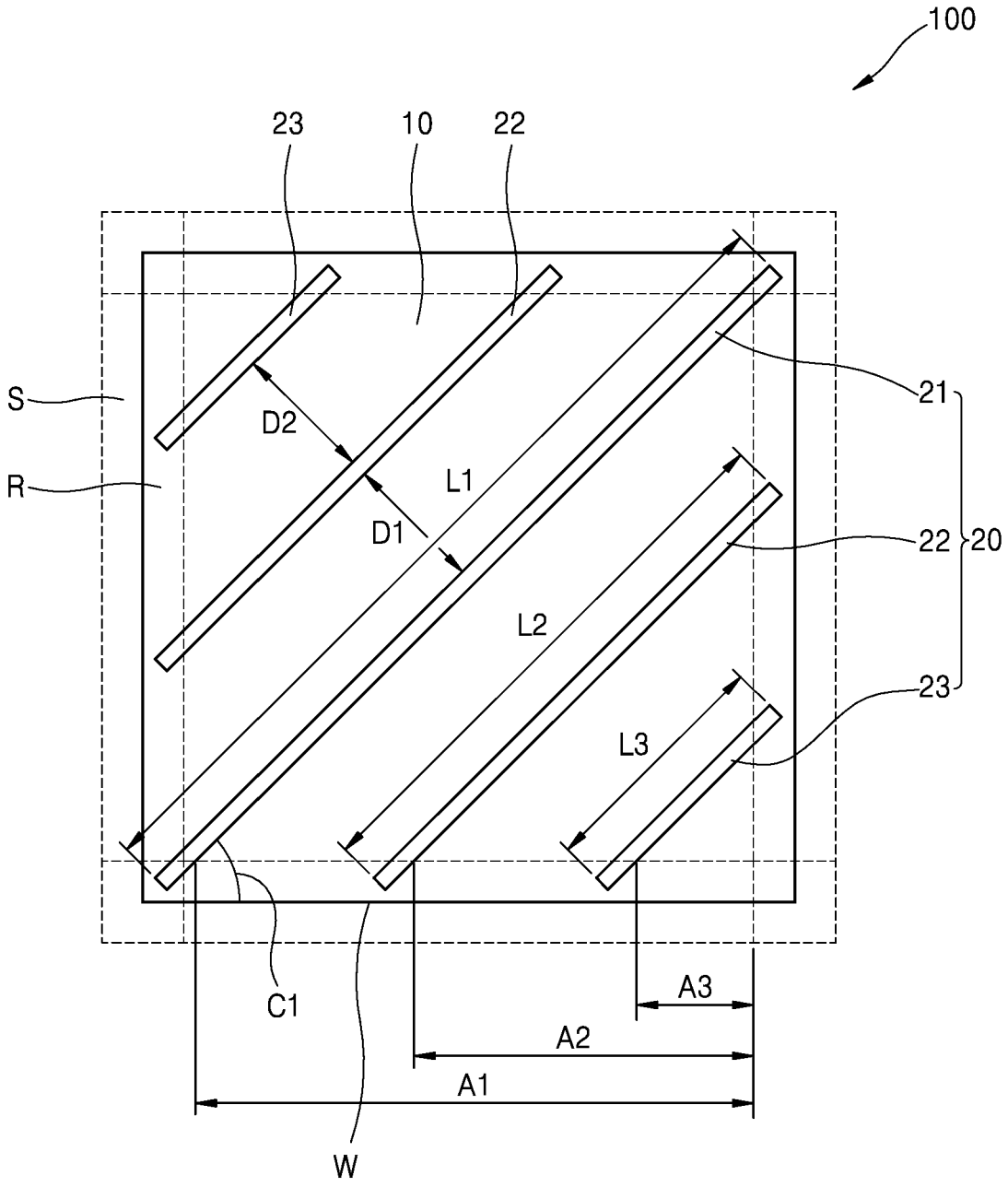
FIG. 3 is a plan view of a ceiling panel apparatus according to an embodiment of the present invention.
Figure 4:
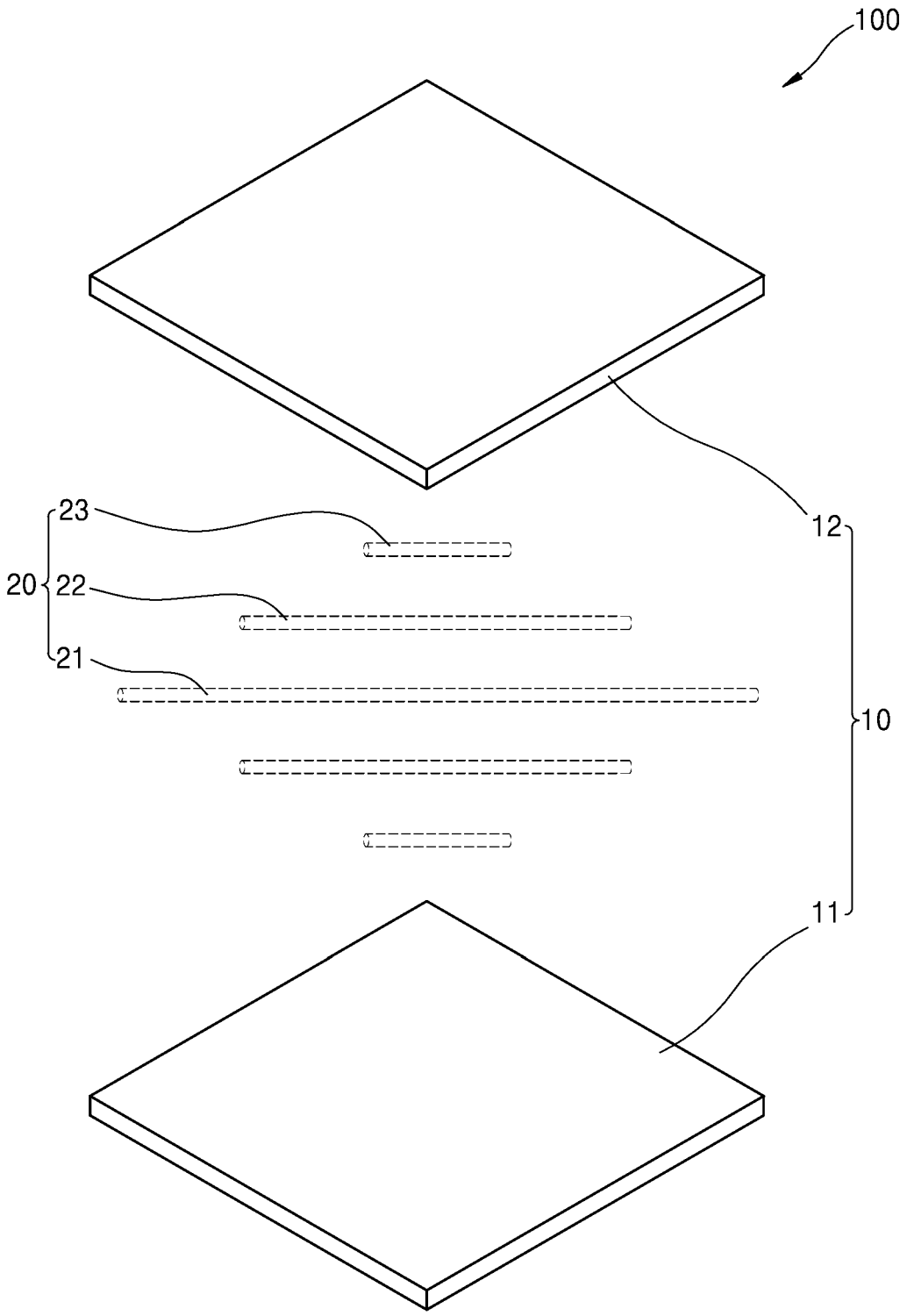
FIG. 4 is an exploded perspective view of a ceiling panel apparatus according to an embodiment of the present invention.

FIG. 1 is a perspective view of a ceiling panel apparatus 100 according to an embodiment of the present invention, FIG. 2 is a cross-sectional view of the ceiling panel apparatus 100 taken along line B-B of FIG. 1, FIG. 3 is a plan view of the ceiling panel apparatus 100 according to an embodiment of the present invention, and FIG. 4 is an exploded perspective view of the ceiling panel apparatus 100 according to an embodiment of the present invention.

Figure 5:
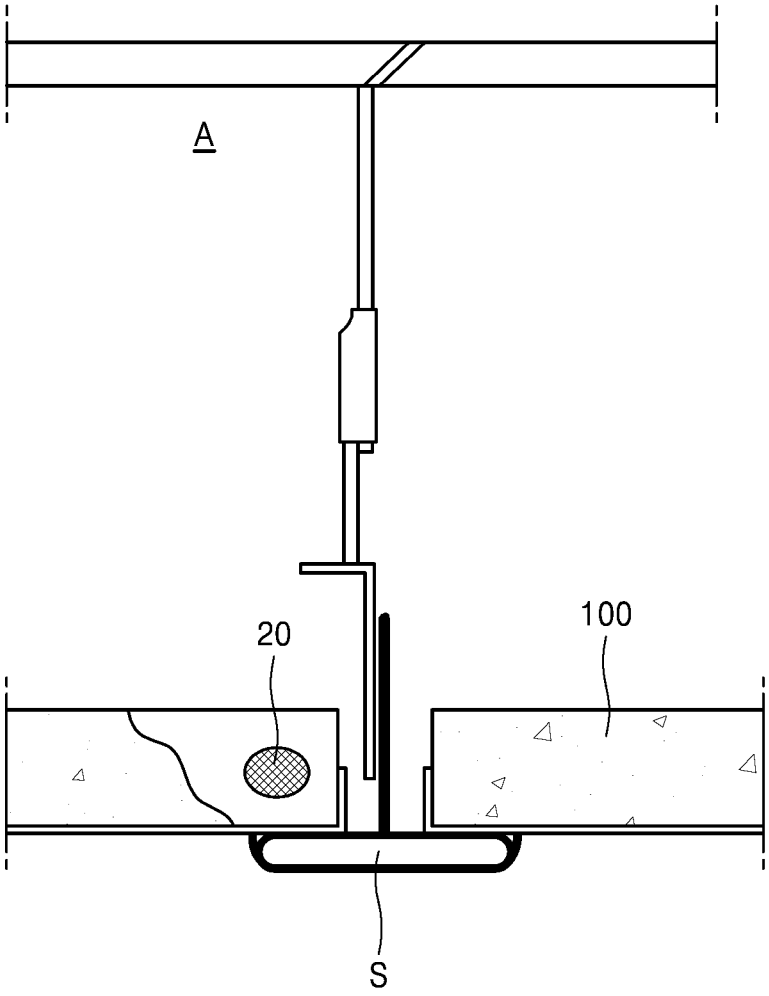
FIG. 5 is a partial cross-sectional view showing that a ceiling panel apparatus according to an embodiment of the present invention is mounted together with a ceiling support.
Figure 6:
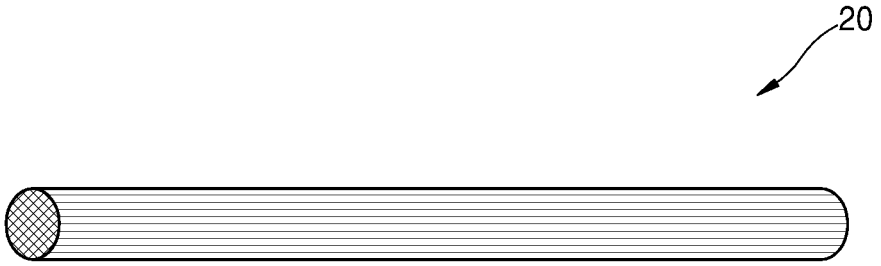
FIG. 6 is a perspective view of a reinforcing member of a ceiling panel apparatus according to an embodiment of the present invention.
Figure 7:
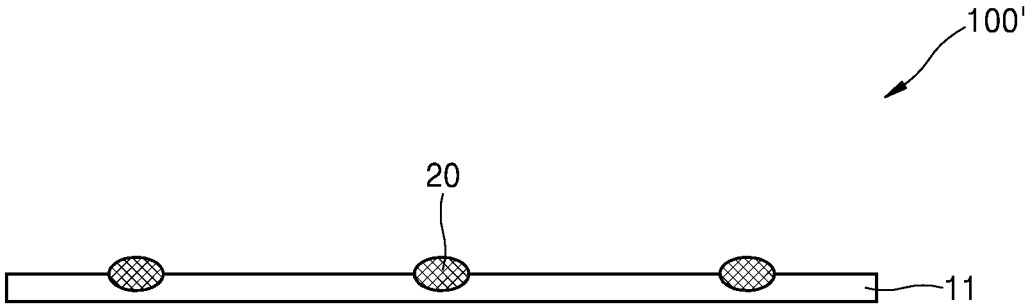
FIG. 7 is a cross-sectional view of a ceiling panel apparatus according to another embodiment of the present invention.

FIG. 5 is a partial cross-sectional view showing that the ceiling panel apparatus 100 according to an embodiment of the present invention is mounted together with a ceiling support S, FIG. 6 is a perspective view of a reinforcing member 20 of the ceiling panel apparatus 100 according to an embodiment of the present invention, and FIG. 7 is a cross-sectional view of a ceiling panel apparatus 100' according to another embodiment of the present invention.

Initially, as shown in FIG. 1, the ceiling panel apparatus 100 according to an embodiment of the present invention may include a base 10 and reinforcing members 20.

The base 10 may substantially have a rectangular plate shape and be made of a first material.

For example, the base 10 may be a square-shaped plate or panel with horizontal and vertical sides W and H of equal length. In this case, the length of the base 10 may be determined in various ways depending on user requirements.

For example, the first material of the base 10 may be an eco-friendly material including a cork material made by selecting at least one of oak, cypress, cork oak, and combinations thereof. As such, the base 10 may be compressed to the reinforcing members 20 at high temperature or high pressure.

Herein, the cork is a protective tissue formed around stems or roots of a plant and may be a regular or irregular cellular tissue created by the split of cork cambium.

The cork may exhibit excellent properties in eco-friendliness, thermal insulation, sound absorption, fire resistance, impact absorption, electrical insulation, etc. Particularly, oak cork or cypress cork may be used to purify indoor air or remove fine dust with phytoncides or a unique scent.

Therefore, in addition to tactile and visual improvements of products, eco-friendliness, thermal insulation, sound absorption, fire resistance, impact absorption, electrical insulation, etc. of the products may be improved by forming the surface of the products with the cork material which is a vegetable tissue.

In particular, cypress cork has excellent antibacterial and bactericidal properties and contains large amounts of natural antibacterial substances called phytoncides, and also has high water resistance and a strong unique scent to remove unpleasant odors, thereby enabling the production of high value-added products.

Specifically, referring to FIGS. 2 and 7, the base 10 may include a first layer 11 or a second layer 12.

The first layer 11 may be provided on lower surfaces of the reinforcing members 20. For example, the first layer 11 may be compressed to the lower surfaces of the reinforcing members 20, or applied to the reinforcing members 20 by mixing cork powder and an eco-friendly adhesive. However, the first layer 11 is not limited thereto and may be formed in various ways.

As such, referring to FIG. 7, the ceiling panel apparatus 100' may be manufactured by forming the first layer 11, disposing the reinforcing members 20 thereon, and combining them in various ways, e.g., bonding or compressing.

Therefore, by mounting the ceiling panel apparatus 100' on the ceiling A with the first layer 11 facing downward, the weight of the ceiling panel apparatus 100' itself may be reduced and a cost of producing the ceiling panel apparatus 100' may also be reduced.

The second layer 12 may be provided on upper surfaces of the reinforcing members 20 and integrated with the first layer 11. For example, the second layer 12 may be compressed to the upper surfaces of the reinforcing members 20 and integrated with the first layer 11 through gaps between the reinforcing members 20, or applied to the first layer 11 and the reinforcing members 20 by mixing cork powder and an eco-friendly adhesive. However, the second layer 12 is not limited thereto and may be formed in various ways.

Therefore, the base 10 may form the appearance of products, and the first and second layers 11 and 12 may be connected through the gaps between the reinforcing members 20 to prevent separation and achieve high structural robustness based on high adhesion, thereby greatly increasing the strength and durability of the products.

One or more reinforcing members 20 may substantially have a rod shape, be made of a second material, and be provided in the base 10 to prevent sagging of the base 10.

For example, the second material of the reinforcing members 20 may be a material including rods made by selecting and cutting at least one of bamboo, paulownia, oak, cypress, wood, pulp, paper, natural resin, synthetic resin, and combinations thereof.

When the reinforcing members 20 are made of an eco-friendly material, eco-friendliness of products may be greatly improved and user requirements for materials that are not harmful to the human body may be satisfied.

Alternatively, the second material of the reinforcing members 20 may include rods made by selecting and cutting one of low-rust metal, stainless steel, aluminum, copper, and combinations thereof. In this case, the reinforcing members 20 may have a pipe shape.

As such, the weight of the reinforcing members 20 may be reduced to reduce a load applied to the base 10, and the reinforcing members 20 may not rust to achieve a high durability.

Specifically, referring to FIG. 6, the second material of the reinforcing members 20 may be bamboo, the reinforcing members 20 may have a circular rod shape, and the bamboo may have a grain pattern extending along a longitudinal direction of the reinforcing members 20 on outer circumferential surfaces of the reinforcing members 20.

As such, due to the grain pattern of the bamboo extending along the longitudinal direction of the reinforcing members 20, the base 10 may be firmly supported in horizontal and vertical directions, warping or tilting of the base 10 caused by an internal factor such as a weak supporting force may be prevented, and separation between the base 10 and the reinforcing members 20 caused by the warping or tilting may also be prevented. In addition, air permeability of the bamboo may prevent warping or tilting caused by an external factor such as moisture.

For example, when the second material is bamboo, the bamboo may be split into a plurality of pieces along a longitudinal direction of the bamboo, and the split pieces may be processed into a circular rod shape by, for example, grinding outer circumferential surfaces thereof. Therefore, a processing time and a processing cost may be reduced by processing the bamboo itself, thereby increasing the efficiency of production and reducing a cost for products. The reinforcing members 20 may be fixed and flattened with a press or a high load to prevent warping.

In this case, the reinforcing members 20 may be formed by preparing the second material, processing the second material into the shape of the reinforcing members 20, and then fixing the second material with a press or a high load for a certain time, or by preparing the second material, and then processing the second material into the shape of the reinforcing members 20 and simultaneously fixing the second material with a press or a high load for a certain time.

As such, when the base 10 is fixed to the reinforcing members 20, although the base 10 is warped over time due to a factor such as absorption of moisture, the reinforcing members 20 formed to prevent warping may prevent sagging of the ceiling panel apparatus 100.

The reinforcing members 20 may be disposed in a diagonal direction of the base 10. As such, the reinforcing members 20 do not support only one direction but may be strong against a horizontal load and a vertical load or a torsional load to firmly support the base 10.

For example, the reinforcing members 20 may be spaced apart from each other by certain distances. Due to this arrangement, the reinforcing members 20 may uniformly support the whole surface of the base 10.

When a length of the ceiling panel apparatus 100 is greater than or equal to 300 mm, a thickness of the reinforcing members 20 may be greater than or equal to 40% to 70% of the thickness of the base 10.

In this regard, according to an existing ceiling panel apparatus, when existing reinforcing members are not provided linearly but cross or overlap each other, the existing reinforcing members are warped or deformed so as not to maintain their straightness at 300 mm or more. To solve the above problem, the reinforcing members 20 may be disposed in a diagonal direction and spaced apart from each other by certain distances, thereby maintaining the straightness of the reinforcing members 20 at 300 mm or more.

The reinforcing members 20 may have a straightness of 0.3% to 0.5%. For example, the straightness may have a deviation less than or equal to 3 mm to 5 mm per 1,000 mm.

As shown in FIG. 3, the reinforcing members 20 may include a first reinforcing member 21, second reinforcing members 22, and third reinforcing members 23.

The first reinforcing member 21 may be mounted in the base 10 to extend a first length L1.

For example, the first reinforcing member 21 may be disposed at a position of a first diagonal or a second diagonal of the base 10. Herein, the first or second diagonal may have a first angle C1. The first angle C1 may be 40° to 50° or 130° to 140° with respect to the horizontal side W of the base 10. Specifically, the first angle C1 may be 45° or 135°.

The second reinforcing members 22 may be mounted in the base 10 to extend a second length L2 less than the first length L1 and disposed at positions spaced apart from the first reinforcing member 21 by a first distance D1.

For example, the second reinforcing members 22 may be disposed to have the same diagonal direction as the first reinforcing member 21. As such, the reinforcing members 20 may be disposed to maintain a linear shape.

The first distance D1 may be set as desired by a user based on the length of the horizontal and vertical sides W and H of the base 10.

The third reinforcing members 23 may be mounted in the base 10 to extend a third length L3 less than the second length L2 and disposed at positions spaced apart from the second reinforcing members 22 by a second distance D2.

For example, the third reinforcing members 23 may be disposed to have the same diagonal direction as the second reinforcing members 22.

The second distance D2 may be set as desired by a user based on the length of the horizontal and vertical sides W and H of the base 10, and be the same as the first distance D1, but is not limited thereto.

For example, the first length L1 may be a sum of the second and third lengths L2 and L3. As such, the reinforcing members 20 with various lengths may be formed within a short time by forming a plurality of first reinforcing members 21 having the first length L1 and then cutting some of the first reinforcing members 21 at once. By forming the first reinforcing member 21 having the first length L1 in a large quantity, the reinforcing members 20 may not be separately formed for different lengths and thus a cost of producing products may be reduced.

For example, the reinforcing members 20 may be disposed in a first diagonal direction and mounted to be symmetrical to each other about the first diagonal direction, or disposed in a second diagonal direction and mounted to be symmetrical to each other about the second diagonal direction.

Due to the above-described structure, the whole surface of the base 10 may be uniformly supported and thus sagging of any portion of the base 10 and separation between the base 10 and the reinforcing members 20 may be prevented.

As shown in FIG. 5, when the ceiling panel apparatus 100 is mounted on the ceiling A, the ceiling panel apparatus 100 may be disposed on top of the ceiling support S hanging from the ceiling A. In this case, the ceiling panel apparatus 100 may be supported by the ceiling support S. For example, a connection member may be provided between the ceiling panel apparatus 100 and the ceiling support S, but is not limited thereto.

Referring to FIG. 3, the reinforcing members 20 may extend at both ends to an overlap region R where the edge of the base 10 overlaps the ceiling support S.

Due to the above-described structure, when the ceiling panel apparatus 100 is mounted on the ceiling A and supported by the ceiling support S, the reinforcing members 20 provided in the base 10 may be stretched over the ceiling support S and thus the base 10 may be firmly supported.

For example, the base 10 may have a square shape with horizontal and vertical sides W and H of equal length, and the first length L1 of the first reinforcing member 21 may be greater than a product of the square root of 2 and a first underside length A1 of the overlap region R which meets the first reinforcing member 21. In this case, the first reinforcing member 21 may extend no longer than a diagonal length of the base 10 so as not to deteriorate the appearance, and be entirely in close contact with the base 10.

As another example, the base 10 may have a square shape with horizontal and vertical sides W and H of equal length, and the second length L2 of the second reinforcing members 22 may be greater than a product of the square root of 2 and a second underside length A2 of the overlap region R which meets the second reinforcing members 22.

As still another example, the base 10 may have a square shape with horizontal and vertical sides W and H of equal length, and the third length L3 of the third reinforcing members 23 may be greater than a product of the square root of 2 and a third underside length A3 of the overlap region R which meets the third reinforcing members 23.

As such, at least portions of the both ends of the reinforcing members 20 may overlap the ceiling support S from a vertically upward direction and be supported by the ceiling support S to implement a structure capable of firmly supporting the base 10, thereby greatly increasing the strength and durability of products.

Therefore, based on the ceiling panel apparatus 100 or 100' according to an embodiment of the present invention, eco-friendliness, thermal insulation, sound absorption, fire resistance, impact absorption, electrical insulation, etc. of products may be greatly improved using the base 10 and the reinforcing members 20 made of eco-friendly materials, a structure capable of firmly supporting the base 10 may be implemented because the reinforcing members 20 may extend to the overlap region R where the edge of the base 10 overlaps the ceiling support S, and warping or tilting of the base 10 may be prevented to increase the durability of products and reduce a time and a cost for maintenance or the like.

A method of manufacturing the above-described ceiling panel apparatus 100 will now be described in detail.

Figure 8:
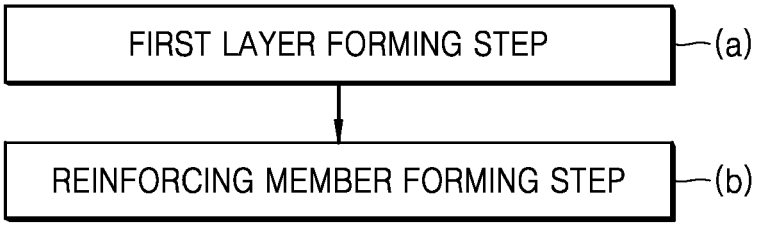
FIGS. 8 and 9 are flowcharts of a method of manufacturing a ceiling panel apparatus, according to various embodiments of the present invention.
Figure 9:
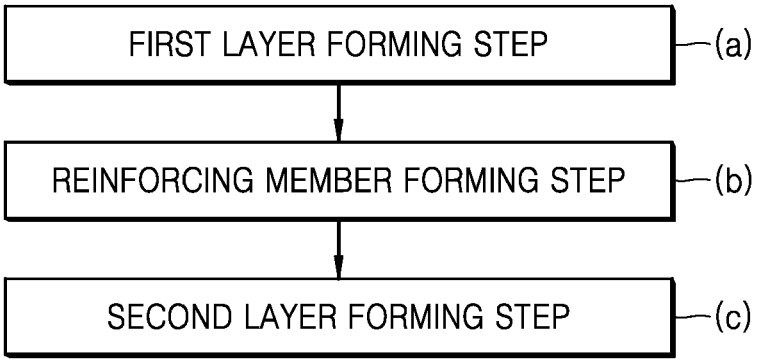
Figure 10:
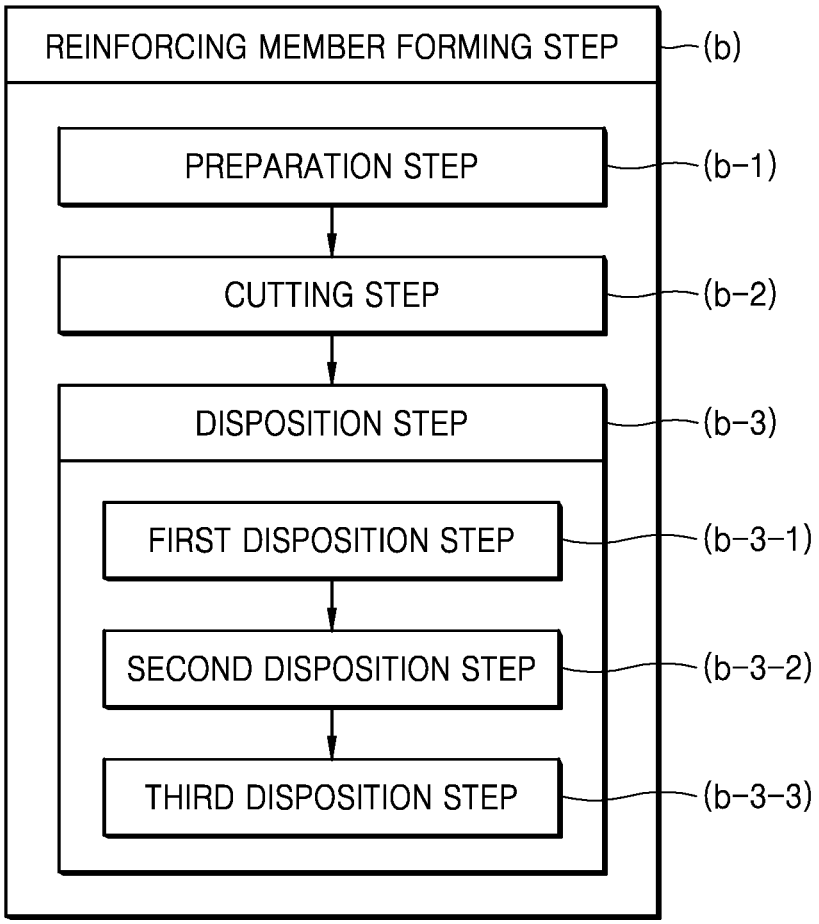
FIG. 10 is a detailed flowchart of a part of a method of manufacturing a ceiling panel apparatus, according to an embodiment of the present invention.

FIGS. 8 and 9 are flowcharts of a method of manufacturing the ceiling panel apparatus 100, according to various embodiments of the present invention, and FIG. 10 is a detailed flowchart of a part of the method of manufacturing the ceiling panel apparatus 100, according to an embodiment of the present invention.

As shown in FIG. 8, the method of manufacturing the ceiling panel apparatus 100, according to various embodiments of the present invention, may include a first layer forming step (a) for forming the first layer 11 substantially having a rectangular plate shape and made of a first material, and a reinforcing member forming step (b) for forming one or more reinforcing members 20 substantially having a rod shape, made of a second material, and provided in a diagonal direction on an upper surface of the first layer 11 to prevent sagging.

In this case, as shown in FIG. 9, the method may further include, after the reinforcing member forming step (b), a second layer forming step (c) for forming the second layer 12 substantially having a rectangular plate shape, made of the first material, and provided on upper surfaces of the first layer 11 and the one or more reinforcing members 20.

For example, in the reinforcing member forming step (b), the second material may be bamboo, the reinforcing members 20 may have a circular rod shape, and the bamboo may have a grain pattern extending along a longitudinal direction of the reinforcing members 20 on outer circumferential surfaces of the reinforcing members 20.

Herein, the reinforcing members 20 may be formed by splitting the bamboo into a plurality of pieces along a longitudinal direction of the bamboo, processing the split pieces into a circular rod shape by, for example, grinding outer circumferential surfaces thereof, and cutting the processed bamboo rods to desired lengths.

As such, products that are harmless not only to the health of users but also to the environment may be produced by forming the reinforcing members 20 with an eco-friendly material, and a production time and a production cost may be reduced by directly processing bamboo compared to other production methods.

In addition, in the reinforcing member forming step (b), the reinforcing members 20 may extend at both ends to the overlap region R where the edge of the base 10 overlaps the ceiling support S.

Specifically, as shown in FIG. 8, the reinforcing member forming step (b) may include a preparation step (b-1) for preparing three reinforcing members 20 having the first length L1, a cutting step (b-2) for using one of the reinforcing members 20 as the first reinforcing member 21 and cutting the other two to prepare two second reinforcing members 22 having the second length L2 and two third reinforcing members 23 having the third length L3, and a disposition step (b-3) for disposing the second and third reinforcing members 22 and 23 at both sides of the first reinforcing member 21.

Specifically, the disposition step (b-3) may include a first disposition step (b-3-1) for disposing the first reinforcing member 21 in a first diagonal direction, a second disposition step (b-3-2) for disposing the second reinforcing members 22 in the first diagonal direction at positions spaced apart from the first reinforcing member 21 by the first distance D1, and a third disposition step (b-3-3) for disposing the third reinforcing members 23 in the first diagonal direction at positions spaced apart from the second reinforcing members 22 by the second distance D2.

In the reinforcing member forming step (b), the reinforcing members 20 may be fixed and flattened with a press or a high load to prevent warping.

In this case, the reinforcing members 20 may be formed by preparing the second material, processing the second material into the shape of the reinforcing members 20, and then fixing the second material with at least one of a press, a high load, and a high temperature for a certain time, or by preparing the second material, and then processing the second material into the shape of the reinforcing members 20 and simultaneously fixing the second material with at least one of a press, a high load, and a high temperature for a certain time.

As such, when the base 10 is fixed to the reinforcing members 20, although the base 10 is warped over time due to a factor such as absorption of moisture, the reinforcing members 20 formed to prevent warping may prevent sagging of the ceiling panel apparatus 100.

Therefore, based on the method of manufacturing the ceiling panel apparatus 100, according to another embodiment of the present invention, by forming the first layer 11, disposing the reinforcing members 20, and then forming the second layer 12, the adhesion between the base 10 and the reinforcing members 20 may be increased and thus structural robustness and a great increase in strength and durability may be achieved.

In addition, by forming a plurality of first reinforcing members 21 having the first length L1 and then cutting some into the second and third lengths L2 and L3, only the first reinforcing members 21 having the first length L1 may be prepared in a large quantity for the reinforcing members 20 and thus a time and operations for processing may be reduced to implement an efficient manufacturing procedure.

According to the afore-described embodiments of the present invention, by forming a base with a cork material and forming reinforcing members with a material such as bamboo, paulownia, oak, cypress, or wood, the weight of products may be reduced and, at the same time, thermal insulation, sound absorption, fire resistance, impact absorption, electrical insulation, etc. of the products may be greatly improved, and eco-friendly products that do not harm the health of users or the environment may be produced.

In addition, because the reinforcing members substantially having a rod shape are disposed in a diagonal direction in the base to achieve a strength against a horizontal load and a vertical load or a torsional load, and extend to an overlap region where the base overlaps a ceiling support, the base may be firmly supported and sagging of the base and separation between the base and the reinforcing members may be prevented. However, the scope of the present invention is not limited to the above effects.

While the present invention has been particularly shown and described with reference to embodiments thereof, it will be understood by one of ordinary skill in the art that various changes in form and details may be made therein without departing from the scope of the present invention as defined by the following claims.

What is claimed is:

1. A ceiling panel apparatus comprising:

a base substantially having a rectangular plate shape and made of a first material; and one or more reinforcing members substantially having a rod shape, made of a second material, and provided in the base to prevent sagging of the base, the one or more reinforcing members comprising:

a first reinforcing member mounted in the base to extend a first length;

at least one second reinforcing member mounted in the base to extend a second length less than the first length and disposed at a position spaced apart from the first reinforcing member by a first distance; and at least one third reinforcing member mounted in the base to extend a third length less than the second length and disposed at a position spaced apart from the at least one second reinforcing member by a second distance, wherein the one or more reinforcing members are disposed in a diagonal direction of the base.

2. The ceiling panel apparatus of claim 1, wherein the first material is an eco-friendly material comprising a cork material made by selecting at least one of oak, cypress, cork oak, and combinations thereof, and wherein the second material is a material comprising rods made by selecting and cutting at least one of bamboo, paulownia, oak, cypress, wood, pulp, paper, natural resin, synthetic resin, and combinations thereof, or one of low-rust metal, stainless steel, aluminum, copper, and combinations thereof.

3. The ceiling panel apparatus of claim 2, wherein the second material is bamboo, wherein the one or more reinforcing members have a circular rod shape, and wherein the bamboo has a grain pattern extending along a longitudinal direction of the one or more reinforcing members on outer circumferential surfaces of the one or more reinforcing members.

4. The ceiling panel apparatus of claim 1, wherein, when the one or more reinforcing members include a plurality of reinforcing members, the plurality of reinforcing members are spaced apart from each other by certain distances.

5. The ceiling panel apparatus of claim 1, wherein the base is a square-shaped plate or panel with horizontal and vertical sides of equal length.

6. The ceiling panel apparatus of claim 1, wherein the one or more reinforcing members extend at both ends to an overlap region where an edge of the base overlaps a ceiling support.

7. The ceiling panel apparatus of claim 1, wherein the first length is a sum of the second and third lengths.

8. The ceiling panel apparatus of claim 1, wherein the base has a square shape with horizontal and vertical sides of equal length, and wherein the first length of the first reinforcing member is greater than a product of a square root of 2 and a first underside length of an overlap region which meets the first reinforcing member.

9. The ceiling panel apparatus of claim 8, wherein the second length of the at least one second reinforcing member is greater than a product of the square root of 2 and a second underside length of the overlap region which meets the at least one second reinforcing member.

10. The ceiling panel apparatus of claim 9, wherein the third length of the at least one third reinforcing member is greater than a product of the square root of 2 and a third underside length of the overlap region which meets the at least one third reinforcing member.

11. The ceiling panel apparatus of claim 1, wherein the base comprises:

a first layer provided on lower surfaces of the one or more reinforcing members; or a second layer provided on upper surfaces of the one or more reinforcing members and integrated with the first layer.

12. A method of manufacturing a ceiling panel apparatus, the method comprising:

a first layer forming step for forming a first layer substantially having a rectangular plate shape and made of a first material; and a reinforcing member forming step (for forming one or more reinforcing members substantially having a rod shape, made of a second material, and provided in a diagonal direction on an upper surface of the first layer to prevent sagging, wherein the reinforcing member forming step comprises:

a preparation step for preparing three reinforcing members having a first length;

a cutting step for using one of the three reinforcing members as a first reinforcing member and cutting the other two to prepare two second reinforcing members having a second length and two third reinforcing members having a third length; and a disposition step for disposing the two second reinforcing member and the two third reinforcing member at both sides of the first reinforcing member.

13. The method of claim 12, further comprising, after the reinforcing member forming step, a second layer forming step for forming a second layer substantially having a rectangular plate shape, made of the first material, and provided on upper surfaces of the first layer and the one or more reinforcing members.

14. The method of claim 12, wherein, in the reinforcing member forming step, the second material is bamboo, the one or more reinforcing members have a circular rod shape, and the bamboo has a grain pattern extending along a longitudinal direction of the one or more reinforcing members on outer circumferential surfaces of the one or more reinforcing members.

15. The method of claim 12, wherein, in the reinforcing member forming step, the one or more reinforcing members extend at both ends to an overlap region where an edge of a base overlaps a ceiling support.

16. The method of claim 12, wherein, in the reinforcing member forming step, the one or more reinforcing members are fixed and flattened with at least one of a press, a high load, and a high temperature to prevent warping.

17. A ceiling panel apparatus comprising:

a base substantially having a rectangular plate shape and made of a first material; and one or more reinforcing members substantially having a rod shape, made of a second material, and provided in the base to prevent sagging of the base, wherein the base is a square-shaped plate or panel with horizontal and vertical sides of equal length, wherein the one or more reinforcing members are disposed in a diagonal direction of the base, extend at both ends to an overlap region where an edge of the base overlaps a ceiling support, and comprise:

a first reinforcing member mounted in the base to extend a first length;

at least one second reinforcing member mounted in the base to extend a second length less than the first length and disposed at a position spaced apart from the first reinforcing member by a first distance; and at least one third reinforcing member mounted in the base to extend a third length less than the second length and disposed at a position spaced apart from the at least one second reinforcing member by a second distance, wherein the first material is an eco-friendly material comprising a cork material made by selecting at least one of oak, cypress, cork oak, and combinations thereof, wherein the second material is bamboo, wherein the one or more reinforcing members have a circular rod shape, and wherein the bamboo has a grain pattern extending along a longitudinal direction of the one or more reinforcing members on outer circumferential surfaces of the one or more reinforcing members.

* * * * *